United States Patent [19]

Calmes

[11] 3,946,586

[45] Mar. 30, 1976

[54] PROCESS AND APPARATUS FOR ROLLING SEAMLESS TUBES

[75] Inventor: Jean Paul Calmes, Lausanne, Switzerland

[73] Assignee: Innocenti Santeustacchio S.p.A., Brescia, Italy

[22] Filed: Jan. 15, 1975

[21] Appl. No.: 541,310

Related U.S. Application Data

[62] Division of Ser. No. 435,397, Jan. 21, 1974, abandoned.

[30] Foreign Application Priority Data

Jan. 23, 1973 Italy ..... 19495/73

[52] U.S. Cl. ..... 72/201; 72/208

[51] Int. Cl.[2] ..... B21B 25/04

[58] Field of Search ..... 72/200–202, 72/208, 209

[56] References Cited

UNITED STATES PATENTS

| | | | |
|---|---|---|---|
| 1,936,790 | 11/1933 | Heetkamp | 72/209 |
| 2,024,514 | 12/1935 | Drescher | 72/234 X |
| 2,356,734 | 8/1944 | Bannister | 72/209 |
| 3,782,160 | 1/1974 | Kheifets et al. | 72/201 |

*Primary Examiner*—Milton S. Mehr

*Attorney, Agent, or Firm*—Sughrue, Rothwell, Mion & Zinn

[57] ABSTRACT

In the rolling of seamless tubes using a mandrel which is inserted in a hollow bloom as it is advanced through a rolling mill, the cooling of the mandrel after the tube rolling stage is effected, for example by passing the mandrel through a cooling bath, as the mandrel is returned to a ready position upstream of the mill along a return path which is at one side of the rolling axis, so that while this mandrel is being cooled a further rolling operation can be carried out using another mandrel, the mandrels being moved in a closed cycle of successive rolling and cooling stages.

7 Claims, 3 Drawing Figures

PROCESS AND APPARATUS FOR ROLLING SEAMLESS TUBES

This is a division of application Ser. No. 435,397, filed Jan. 21, 1974, now abandoned.

This invention concerns a method for rolling seamless tubes comprising a rolling stage, in which the tube to be rolled is made to pass through a train of rolls on a mandrel restrained at its head end, and a cooling stage.

The invention also concerns apparatus for carrying out the said method, of the kind comprising a train of rolls and a device upstream of the said train of rolls to restrain and to move in a controlled manner the mandrels inserted in the hollow ingots or blooms which are to be rolled.

BACKGROUND OF THE INVENTION

Methods of rolling seamless tubes are known using a continuous multiple stand rolling mill and a restrained mandrel which is advanced at a constant controlled speed during rolling.

For rolling using an installation of this type, an ingot or hollow bloom is set up on a support in front of the multiple stand rolling mill, and a mandrel is inserted through the said bloom as far as the rolling position. In this position, the head of the mandrel rests, behind the bloom, against a restraining cross-piece which is initially stationary. Upon the introduction of the bloom between the first pair of rollers of the mill, the forward movement of the cross-piece restraining the mandrel is commenced, preferably by withdrawing oil through a constant delivery pump from oleodynamic actuator cylinders controlling the movement of the cross-piece. In this way the speed of advance of the mandrel is controlled at a predetermined rate which depends upon the degree of permissible heating of the surface layer of the said mandrel. The mandrel is lubricated during rolling by the injection of lubricant on to the internal surface of the bloom through a conduit located within the mandrel, the latter being constantly cooled on the inside by means of a continuous current of cold water under pressure (see for example French Patent No. 1,458,432).

After rolling of the tube and extraction of the mandrel, the latter, secured to a longitudinal conveyor device, is withdrawn through the rolling mill and carried to its initial position for the start of a fresh cycle. In order to cool the mandrel completely it is thrust laterally, in the outer cooling position, under coolant showers, whilst a second mandrel, which was in the position of rest and cooling under the showers during the working cycle of the first mandrel, is automatically placed in the working position by the displacement of the first mandrel.

By means of this alternation in working of the two mandrels, a fairly satisfactory production rate can be achieved, but this method has various disadvantages:

the idle periods of insertion, extraction, return and lateral displacement of the mandrel reduced by at least 50% the productive time of the whole cycle;

the changing of the mandrels, secured to mandrel control devices, entails loss of time and interrupts the tube production;

the centre distance between two successive strands of the rolling mill, which is a determining factor for the speed of movement of the mandrel, has to be so limited as not to increase unduly the insertion and return strokes of the mandrels, as well as their weight.

An object of this invention is to eliminate as far as possible the disadvantages referred to above, by providing a manufacturing method by means of which idle times can be noticeably reduced, and rational operational inter-linking achieved, especially with regard to the displacement and cooling of the mandrels.

SUMMARY OF THE INVENTION

According to the invention there is provided a method of rolling seamless tubes, including a rolling stage in which a tube to be rolled is made to pass through a train of rolls upon a mandrel restrained at its head end, and a mandrel cooling stage in which the cooling stage takes place with the mandrel freed from the tube after the rolling stage, and de-coupled from its restraining means, the mandrel being displaced laterally with respect to the rolling axis, after which the said mandrel is made to return to a position upstream of the said train of rollers, to a position for re-use, along a return path at one side of the rolling axis, in which path the mandrel is subjected to cooling, whilst at least one other mandrel is used in at least one further rolling stage to undergo subsequently the cooling treatment, repeated displacement of the mandrels taking place in a closed cycle, in an upstream direction along the laterally displaced return path, in the cooling stage, and in a downstream direction on the axis of rolling, during the rolling stage.

The invention also provides an apparatus for carrying out the method defined above, comprising a train of rolls and a device upstream of the said train of rollers for restraining and displacing in a controlled manner a mandrel inserted into a hollow ingot or bloom to be rolled, the apparatus comprising a mandrel return path, spaced laterally from and substantially parallel to the tube rolling axis, means for displacing each mandrel in an upstream direction along said return path after passing through the train of rolls, and means for cooling the mandrel in said return path.

The advantages afforded by the invention reside in the fact that, instead of making the mandrels return, after rolling, along the working axis of the rolling mill, the mandrels are returned along and cooled in a return path displaced laterally with respect to the said working axis, thus leaving the train of rolls free to carry out, aat the same time, another rolling process, using a mandrel which has previously been cooled.

In this way idle times are reduced, whilst the centre distance between the successive rolling stands can be increased as compared with known installations, given that the mandrels are returned along a different path at one side of the working axis, thereby allowing mechanical members of a larger size to be used in the said stands.

BRIEF DESCRIPTION OF THE DRAWINGS

A preferred embodiment of the invention will now be described, by way of non-restrictive example, with reference to the accompanying drawings, in which.

DETAILED DESCRIPTION WITH REFERENCE TO THE DRAWINGS

Figure 1:
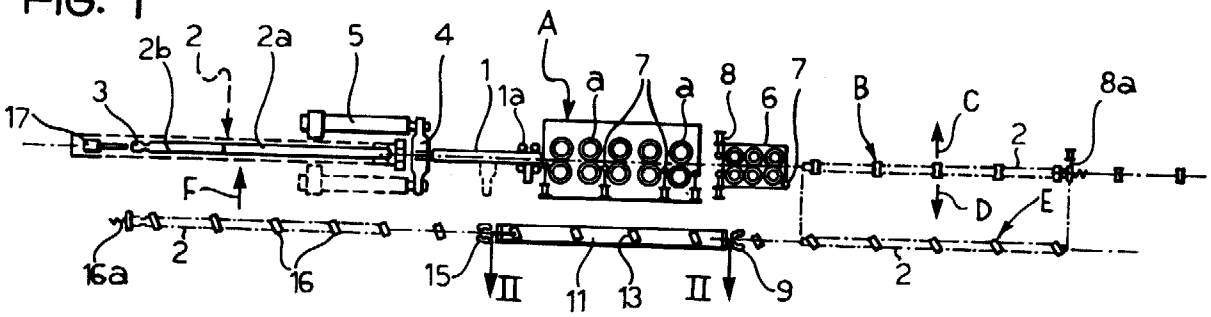
FIG. 1 is a schematic plan view of an apparatus for rolling seamless tubes according to the said embodiment of the invention.

Referring to FIG. 1, the tube rolling method according to the invention commences with the placing of a hollow bloom or ingot 1, previously heated, upon a suitable support including a roller type guide 1*a* at the entrance to a rolling mill A, the bloom 1 being positioned for the insertion of a mandrel 2 prior to the introduction of the bloom into the first stand of the rolling mill A. The rolling mill A is of the continuous multiple stand type: in the example illustrated the mill A has five stands each of which includes a pair of cylindrical rolls *a*. For the sake of simplicity the rolls *a* have all been shown in FIG. 1 with parallel axes, but in fact the axes of the rolls of the second and fourth stands will be perpendicular to the axes of the rolls of the other stands.

The mandrel 2 consists of a working portion 2*a* and an extension 2*b* terminating in a head 3 which is coupled automatically, by means of known systems, to a restraining crosspiece 4 which is displaceable in the longitudinal direction by means of oleodynamic actuator cylinders 5. The bloom 1 (with the mandrel 2) is advanced by the crosspiece 4 to bring it into engagement with the first pair of rolls *a*, whilst a device not shown, of known type, lubricates the mandrel 2.

From this position onwards the rolling of the bloom 1 commences, the speed of advance of the crosspiece 4 being controlled by the cylinders 5 the hydraulic circuit of which includes a constant delivery pump (not shown).

After the passage of the bloom 1 through all the stands of the rolling mill A, the bloom is subjected to the action of a gauge mill 6 located downstream of the rolling mill A. Upon termination of rolling, the rolled tube is removed, by the continued rotation of the rolls, from the mandrel 2 (which is restrained by the crosspiece 4) and will be deposited upon a series of horizontal terminal rollers B from which the tube will be displaced laterally, in the direction of the arrow C, to a further working process or to storage.

After removal of the rolled tube, the mandrel 2 will be supported by rolls 7 provided in the rolling mill A and in the gauge mill 6 while the mandrel 2 is decoupled from the crosspiece 4, which will be returned quickly by the actuator cylinders 5 to its starting point for the commencement of a new operating cycle. The mandrel 2, thus left free, will be borne along by the action of a pair of rotating cylinders 8 placed at the entrance to the gauge mill 6 towards the series of rollers B upon which the mandrel will be stopped, in the position shown by dots and dashes in FIG. 1, by engagement with a terminal stop 8*a*. Immediately after this the mandrel 2 is transferred laterally, in the direction of the arrow D, on to a series of horizontal rollers E arranged alongside the series of rollers B, in a row parallel to the rolling axis of the mill A, the axes of the rollers E being parallel to each other and inclined to the direction of the rolling axis. From this moment the return displacement of the mandrel 2 commences, along a path laterally spaced from and parallel to the rolling axis, on a continuation of the row of inclined rollers E. More exactly, the mandrel 2 is borne along by the action of a helical rotation device 9, of known type, formed by a pair of rollers with mutually inclined axes arranged to induce longitudinal movement and simultaneous rotation of the mandrel about its longitudinal axis, the mandrel 2 being fed into a tubular bath 11 in which it rests upon horizontal rollers 13 the axes of which are parallel to each other and inclined to the longitudinal axis of the bath 11. The mandrel 2, which is hollow throughout its length, causes the automatic operation of a gate 10 at the entrance of the bath 11 by means of photoelectric cells 20 and 22 which register the passage of the head 3 of the mandrel and initiate operation of a fluid actuator cylinder 10*a* controlling the gate 10. As shown on the right of FIG. 2, the gate 10 is moved by the actuator cylinder 10*a* from the position marked by a continuous line, to that marked by dots and dashes.

The bath 11 consists of a tubular container supplied with cooling water by means of suitable pipes. More exactly, as marked by the arrows in FIG. 3, the cooling water enters the bath 11 from below via pipes 12 and leaves the bath through elbow pipes 12*a* which lead the water into vertical discharge pipes 12*b* connected to a drainage system (not shown). Each elbow pipe 12*a* has a downwardly directed outlet which is slightly spaced from a funnel at the inlet of the respective discharge pipe 12*b*, so that the flow of cooling water can be observed. There are also provided additional inlet pipes 12*c* (FIG. 2) in the top of the bath 11, alternating with the elbow pipes 12*a*.

Figure 2:
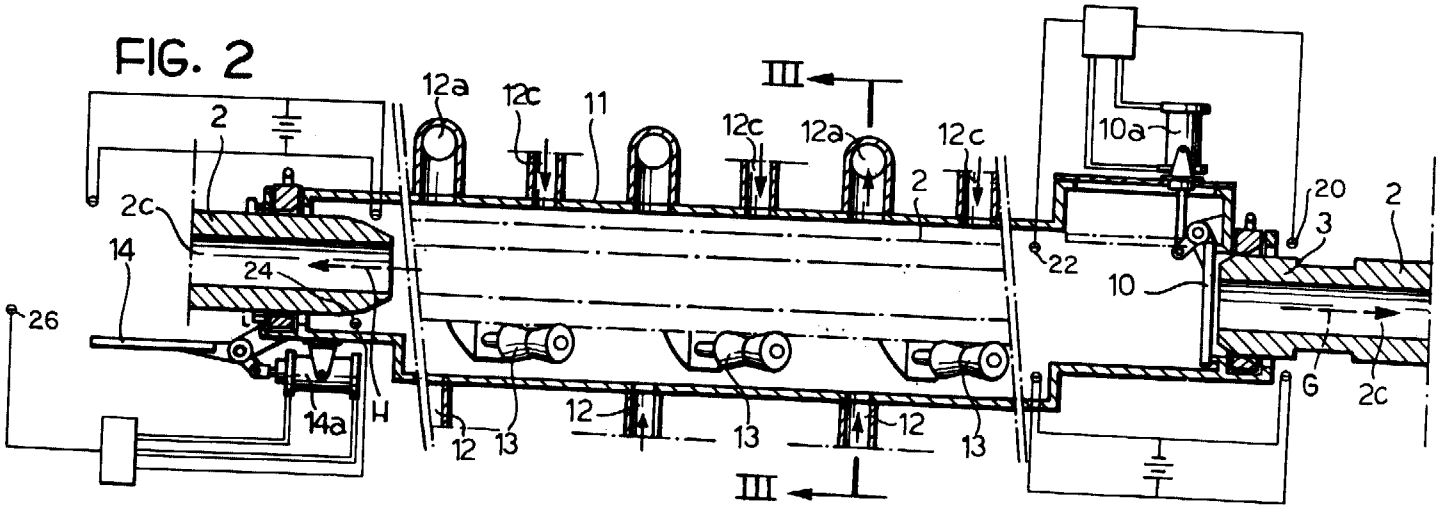
FIG. 2 shows, on an enlarged scale, a longitudinal cross-section taken along the line II—II of FIG. 1, in correspondence with the mandrel cooling quipment.
Figure 3:
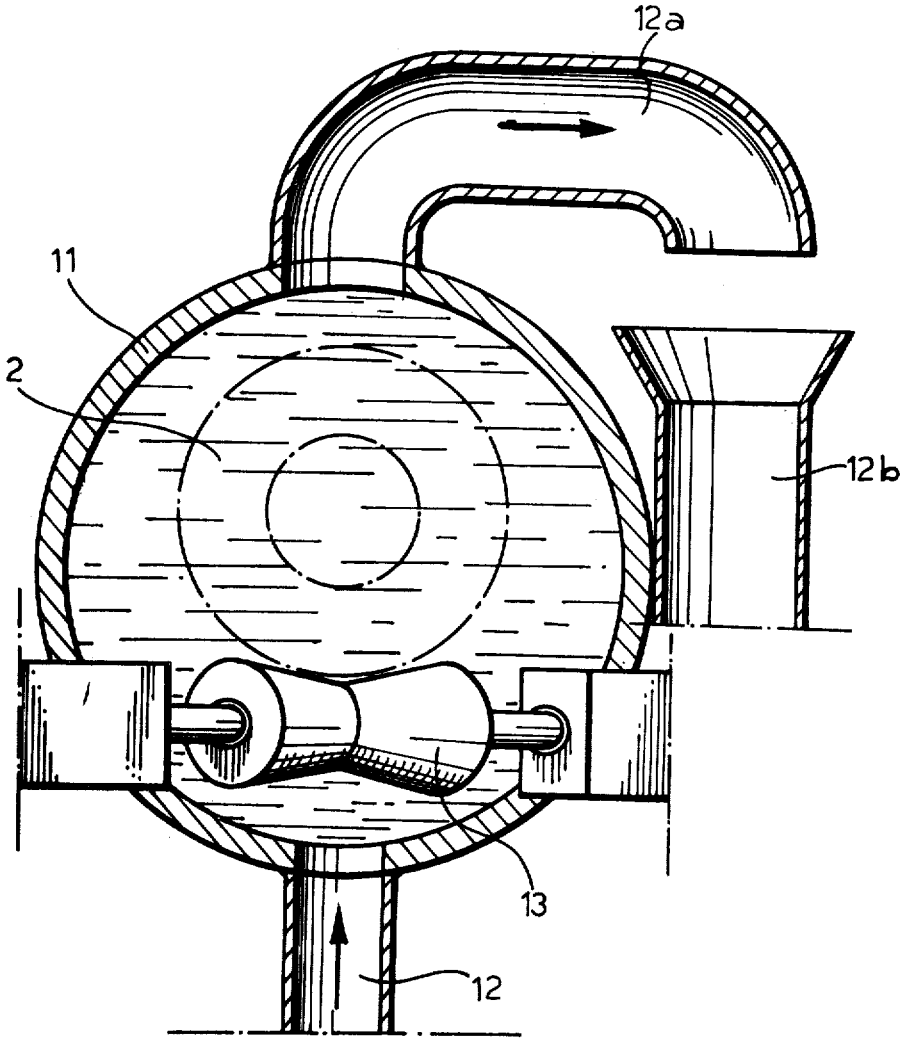
FIG. 3 shows, on a scale further enlarged, a transverse cross section taken along the line III—III of FIG. 2.

As soon as the gate 10 is opened there is a flow of cooling water through the longitudinal cavity 2*c* of the mandrel 2 as shown by the dashed line arrow G on the right of FIG. 2. Thus the internal cooling of the mandrel 2 commences before the mandrel is fully inserted in the bath 11. This is very advantageous in that the mandrel 2 and more particularly its working portion 2*a* connected to the extension 2*b*, undergoes internal cooling before outer cooling begins, so that thermal stresses upon the outer surface of the mandrel are minimised. Completion of the internal cooling and external surface cooling occurs when the mandrel 2 passes into the tubular bath 11.

When the head 3 of the mandrel 2 approaches an exit gate 14 at the opposite end of the bath 11 from the entrance door 10, a photoelectric cell 24 initiates a retraction of a fluid actuator cylinder 14*a* which opens the gate 14, the latter moving from the position marked by dots and dashes to that marked by a continuous line at the left of FIG. 2. The mandrel 2 thereupon emerges from the tubular bath 11, being borne along with helical motion imparted to it by a helical rotation device 15 (consisting of two rollers with mutually inclined axes) similar to the device 9.

The mandrel 2 is thus moved on to a bed of inclined horizontal rollers 16, parallel to the rollers E, upon which the mandrel 2 comes to rest against a stop 16*a* at the position shown by dots and dashes, after complete emergence of the tail end of the mandrel from the bath 11.

During the emergence of the mandrel 2 from the bath 11, the cooling water continues to flow into the longitudinal cavity 2*c* of the mandrel, as shown by the dashed line arrow H in FIG. 2, prolonging the cooling action right up to the emergence of the tail end of the mandrel from the bath 11 which is sensed by photocell 26 to initiate closing of gate 14.

From the bed of rollers 16 the mandrel is now displaced laterally, in the direction of the arrow F in FIG. 1, to be placed in a waiting position onthe rolling axis, ready to be engaged by a thrusting element 17 which brings the mandrel into use at the start of a new rolling cycle.

It will be seen that in the method according to this invention, the return path of each mandrel is not along the rolling axis, as in known methods, so that the tube production capacity of the apparatus is considerably increased, the length of the rolling cycle being markedly reduced, so that the rolling mill can be operated almost continuously.

In practice the method of the invention is carried out with three or more mandrels which during the cooling stage are displaced repeatedly, as described above, in a closed cycle from downstream to upstream of the train of rollers, along a path spaced laterally from the rolling axis, the mandrels being displaced downstream, along the axis of rolling, during the rolling. Thus, whilst one mandrel is travelling along the rolling axis and taking part in the operation of rolling a tubular bloom 1, another mandrel, used in a previous rolling operation, can be displaced in the opposite direction, laterally spaced from the rolling axis, and can at the same time be cooled during its passage through the bath 11.

It should also be observed that the method according to the invention eliminates the time losses involved in previously known methods in changing the mandrels, giving the advantage of a constant production rate.

Embodiments of the invention can have many modifications and variants all coming within the scope of the invention. Thus, for example, in place of the tubular bath 11 a shower cooling system can be used for the mandrels.

I claim:

1. Apparatus for use in rolling seamless tubes, comprising: a train of rolls defining a tube rolling axis; a mandrel adapted to be inserted into a hollow bloom to be rolled, and mandrel restraining and displacing means engageable with the head of the mandrel for controllably displacing the mandrel along the tube rolling axis, wherein the improvement consists in:

a mandrel return path, spaced laterally from and substantially parallel to the tube rolling axis;

return means for displacing said mandrel in an upstream direction along said return path after it has passed through the train of rolls during a rolling stage, and mandrel cooling means in said return path for cooling the mandrel as it moves along said return path comprising a water cooling bath extending parallel to and side-by-side with said train of rolls on said mandrel return path and conveyor means in said bath for passing the mandrel lengthwise through said bath, whereby in operation of the apparatus said mandrel may be cooled along the return path while another said mandrel is displaced along the rolling axis during a further rolling stage.

2. The apparatus defined in claim 1, wherein the mandrel return path is provided with parallel rollers the axes of which are inclined to the rolling axis, and means for rotating said rollers to cause the mandrel to rotate about its longitudinal axis during its longitudinal displacement along the return path.

3. The apparatus defined in claim 2, wherein the mandrel cooling means include a tubular bath, means for circulating coolant liquid in the bath, and automatic closure devices at opposite ends of the bath through which the mandrel respectively enters and leaves the bath.

4. The apparatus defined in claim 3, wherein each said mandrel is hollow throughout its length.

5. The apparatus defined in claim 4 wherein the automatic closure means comprise entrance and exit gates at opposite ends of the bath, fluid-dynamic actuator means operatively connected to said gates, and a control circuit including photoelectric devices sensitive to the passage of one end of each mandrel to cause opening of the respective gates to thereby allow the coolant liquid to flow from the bath through the internal cavity of the mandrel to effect internal cooling thereof as the mandrel enters and leaves the bath.

6. The apparatus as defined in claim 1 wherein said bath is generally tubular and is provided with closure means at each end movable to allow the entry and exit of a mandrel along the mandrel return path.

7. The apparatus as defined in claim 6 wherein said tubular bath has a plurality of axially spaced inlets along the bottom thereof and corresponding water outlets along the top thereof, said outlets being disposed vertically above the respective inlets and additional water inlets disposed along the top thereof intermediate said water outlets.

* * * * *